US006468672B1

(12) United States Patent
Donovan, III et al.

(10) Patent No.: US 6,468,672 B1
(45) Date of Patent: Oct. 22, 2002

(54) DECORATIVE CHROME ELECTROPLATE ON PLASTICS

(75) Inventors: Lawrence P. Donovan, III, Lowell, MI (US); Roger J. Timmer, Lowell, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 0 days.

(21) Appl. No.: 09/606,800

(22) Filed: Jun. 29, 2000

(51) Int. Cl.[7] ..... B32B 15/08; C25D 5/56

(52) U.S. Cl. ..... 428/626; 428/680; 428/935; 205/169; 205/181; 205/187

(58) Field of Search ..... 428/680, 626, 428/935, 936; 205/181, 187, 167, 169

(56) References Cited

U.S. PATENT DOCUMENTS

| | | | | |
|---|---|---|---|---|
| 2,430,581 A | | 11/1947 | Pessel | 117/65 |
| 3,212,917 A | | 10/1965 | Tsu et al. | 117/47 |
| 3,484,282 A | | 12/1969 | Gäbler et al. | 117/130 |
| 3,488,166 A | | 1/1970 | Kovac et al. | 29/195 |
| 3,496,623 A | | 2/1970 | Childers et al. | 29/195 |
| 3,501,332 A | | 3/1970 | Buckman | 117/47 |
| 3,503,783 A | | 3/1970 | Evans | 117/47 |
| 3,513,015 A | | 5/1970 | Fitzpatrick | 117/47 |
| 3,525,635 A | | 8/1970 | Haller | 117/71 |
| 3,533,918 A | | 10/1970 | Smith | 204/30 |
| 3,537,878 A | | 11/1970 | Baudrand et al. | 117/47 |
| 3,558,290 A | | 1/1971 | Baier et al. | 29/195 |
| 3,577,276 A | | 5/1971 | Edge | 117/213 |
| 3,591,352 A | | 7/1971 | Kennedy et al. | 29/195 |
| 3,592,680 A | | 7/1971 | Bayer | 117/47 A |
| 3,592,744 A | | 7/1971 | Grunwald et al. | 204/20 |
| 3,594,229 A | | 7/1971 | Kefalas | 117/237 |
| 3,597,266 A | | 8/1971 | Leibowitz et al. | 117/130 E |
| 3,616,295 A | | 10/1971 | Lee | 204/30 |
| 3,617,320 A | * | 11/1971 | Lee | 106/162 |
| 3,617,343 A | | 11/1971 | Kandler et al. | 117/47 R |
| 3,619,243 A | | 11/1971 | Brindisi, Jr. | 117/47 A |
| 3,619,245 A | | 11/1971 | Maekawa | 117/47 A |
| 3,625,039 A | * | 12/1971 | Kumbach et al. | 72/53 |
| 3,629,922 A | | 12/1971 | Miller | 29/195 |
| 3,642,585 A | | 2/1972 | Lin et al. | 204/30 |
| 3,647,514 A | | 3/1972 | Ahlgrim et al. | 117/47 A |
| 3,650,708 A | | 3/1972 | Gallagher | 29/195 |
| 3,655,531 A | | 4/1972 | Quinn | 204/30 |
| 3,658,661 A | | 4/1972 | Minklei | 204/30 |

(List continued on next page.)

FOREIGN PATENT DOCUMENTS

| | | | |
|---|---|---|---|
| EP | 0799912 B1 | | 10/1997 |
| EP | 1010778 A2 | | 6/2000 |
| GB | 1369037 A | | 10/1974 |
| JP | 50104734 A | | 8/1975 |
| JP | 05287579 A | | 11/1993 |
| JP | 10-018055 | * | 1/1998 |

OTHER PUBLICATIONS

Lowenheimm Frederick A., Electroplating,McGraw–Hill Book Company, published 1978, pp. 211–221. (No Month).*

*Primary Examiner*—John J. Zimmerman
(74) *Attorney, Agent, or Firm*—Price, Heneveld, Cooper, DeWitt & Litton

(57) ABSTRACT

A process for forming a decorative chromium plating on a plastic substrate includes depositing an electrically conductive coating on the plastic substrate, electrodepositing on the electrically conductive coating a high leveling semi-bright nickel electroplate layer, electrodepositing on the high leveling semi-bright nickel electroplate layer a bright nickel electroplate layer, and electrodepositing over the bright nickel electroplate layer a chromium electroplate layer. An advantage of the process is that a lustrous decorative chromium plating having good corrosion resistance and thermal cycling characteristics is obtained without a copper sublayer, and while using relatively thin nickel sublayers.

27 Claims, 1 Drawing Sheet

U.S. PATENT DOCUMENTS 3,666,637 A 5/1972 MacKay ..... 204/30
3,672,940 A 6/1972 Funada et al. ..... 117/47 A
3,674,550 A 7/1972 Mallory ..... 117/212
3,681,114 A 8/1972 Abu-Isa ..... 117/47 A
3,684,572 A 8/1972 Taylor ..... 117/47 A
3,686,019 A 8/1972 Ohfuka ..... 117/47 A
3,692,502 A 9/1972 Bernhardt ..... 29/195
3,709,714 A 1/1973 Lee ..... 117/47 A
3,709,727 A 1/1973 Miller ..... 117/213
3,716,394 A 2/1973 Waggoner et .al. ..... 117/47 A
3,737,339 A 6/1973 Alsberg ..... 117/212
3,771,972 A * 11/1973 Schaer et al. ..... 29/196.6
3,771,973 A 11/1973 Miller ..... 29/195
3,843,493 A 10/1974 Miller ..... 204/30
3,865,699 A 2/1975 Luch ..... 204/20
3,866,288 A 2/1975 Bernard et al. ..... 29/195
3,868,229 A 2/1975 Hurley ..... 29/195
3,900,599 A 8/1975 Feldstein ..... 427/97
3,925,578 A 12/1975 Polichette et al. ..... 427/304
3,930,109 A 12/1975 Brandt et al. ..... 428/422
3,930,807 A 1/1976 Kobayashi et al. ..... 29/195
3,956,535 A 5/1976 Lozier ..... 427/305
3,959,564 A 5/1976 Heymann et al. ..... 427/430
3,962,495 A 6/1976 Feldstein ..... 427/306
3,964,987 A * 6/1976 Reppert et al. ..... 204/197
3,967,010 A 6/1976 Maekawa ..... 427/306
3,993,801 A 11/1976 Feldstein ..... 427/98
4,002,595 A 1/1977 Adelman ..... 260/42.47
4,035,227 A 7/1977 Doty et al. ..... 156/668
4,036,707 A 7/1977 Januschkowetz et al. ..... 204/20
4,039,714 A 8/1977 Roubal et al. ..... 428/336
4,061,802 A 12/1977 Costello ..... 427/304
4,082,621 A 4/1978 Spiliotis et al.
4,087,586 A 5/1978 Feldstein ..... 428/457
4,089,993 A 5/1978 Shirahata et al. ..... 427/129
4,150,177 A 4/1979 Guditz et al. ..... 427/259
4,152,477 A 5/1979 Haruta et al. ..... 428/209
4,160,049 A 7/1979 Narcus ..... 427/277
4,179,343 A * 12/1979 Tremmel ..... 204/43 T
4,258,087 A 3/1981 Feldstein ..... 427/305
4,278,712 A 7/1981 Thomann ..... 427/304
4,278,739 A 7/1981 Coll-Palagos ..... 428/623
4,282,271 A 8/1981 Feldstein ..... 427/98
4,297,397 A 10/1981 Feldstein ..... 427/304
4,301,190 A 11/1981 Feldstein ..... 427/97
4,317,846 A 3/1982 Feldstein ..... 427/98
4,318,940 A 3/1982 Feldstein ..... 427/98
4,321,285 A 3/1982 Feldstein ..... 427/97
4,339,476 A 7/1982 Feldstein ..... 427/98
4,374,709 A 2/1983 Combs ..... 204/30
4,418,125 A 11/1983 Henricks
4,441,969 A * 4/1984 Tremmel ..... 204/49
4,471,015 A 9/1984 Ebneth et al. ..... 428/195
4,508,780 A 4/1985 Sirinyan et al. ..... 428/407
4,517,254 A 5/1985 Grapentin et al. ..... 428/626
4,522,889 A 6/1985 Ebneth et al. ..... 428/614
4,577,549 A 3/1986 Frank et al. ..... 92/169
4,582,564 A 4/1986 Shanefield et al. ..... 156/643
4,600,609 A 7/1986 Leever et al. ..... 427/438
4,673,469 A 6/1987 Beach et al. ..... 204/38.4
4,775,449 A 10/1988 Dumas et al. ..... 204/30
4,820,553 A 4/1989 Sopehak et al. ..... 427/304
4,832,799 A 5/1989 Knudsen et al. ..... 204/22
4,943,355 A 7/1990 Patterson ..... 204/20
4,983,428 A 1/1991 Hodgens, II ..... 427/443.1
4,992,144 A 2/1991 Walsh et al. ..... 204/20
5,024,858 A 6/1991 Burch ..... 427/123
5,135,779 A 8/1992 Viehbeck et al. ..... 427/304
5,180,639 A 1/1993 Zarnoch ..... 428/412
5,192,590 A 3/1993 Sherman ..... 427/304
5,316,867 A 5/1994 Chao et al. ..... 428/626
5,397,599 A 3/1995 Chao et al.
5,413,817 A 5/1995 Chao et al. ..... 427/306
5,478,462 A 12/1995 Walsh ..... 205/169
5,482,738 A 1/1996 Imboh et al. ..... 427/305
5,484,517 A 1/1996 Hopson, Jr. ..... 205/88
5,560,961 A 10/1996 Adel et al. ..... 427/304
6,045,680 A 4/2000 Cawston et al. ..... 205/159

* cited by examiner

DECORATIVE CHROME ELECTROPLATE ON PLASTICS

FIELD OF THE INVENTION

This invention relates to electroplating of plastics, and more particularly to a decorative chrome electroplate on plastic that is free of copper electroplate.

BACKGROUND OF THE INVENTION

Conventional processes for providing a decorative chrome layer on a plastic substrate generally involve preplating the plastic substrate using an electroless nickel or an electroless copper deposition technique to provide electroconductivity on the surface of the plastic substrate, electrodepositing a layer of copper, electrodepositing one or more layers of nickel over the copper layer, and electrodeposting a layer of chromium over the nickel electroplate. It has generally been believed by those skilled in the art that an electrodeposited layer of copper is required to achieve a high degree of leveling needed for a bright chromium plating. Leveling is defined as the ability of a plating solution to deposit an electroplate having smoother surfaces than that of the preplated plastic surfaces. Substrates having high topographical features require a greater degree of leveling than surfaces with few topographical features. It is also generally believed that the copper layer, which is relatively ductile, is needed to meet thermal cycling requirements, i.e., to facilitate thermal expansion and contraction without deterioration, cracking, flaking or delamination of the composite electroplate from the surface of the substrate. The nickel layer, which is much more noble (corrosion resistant) and tarnish resistant than the copper is needed to provide corrosion protection of the underlying copper layer. The precise composition, thickness and process details for the various layers is dependent on the service environment of the plated product. For example, an exterior automotive part, such as a front end grille or a wheel cover, will generally have thicker layers and will be formulated to withstand a more aggressive environment than a decorative part for a household appliance.

The prevailing belief that a copper sublayer is necessary or desirable is evident from industry standards. Industry standards for several types and grades of electrodeposited copper-nickel-chromium coatings on plastic substrates for applications where both appearance and durability of the coating are important have been established in ASTM B-604-75. This standard specifies the minimum thickness for the copper layer that is needed to meet thermal cycling requirements for various service environments. It is also generally believed that it is necessary to maintain a ratio of copper layer thickness to nickel layer thickness of at least 1:1 in order to achieve successful thermal cycle performance. It has also been believed that when relatively thick nickel and/or chromium layers are used, the ratio of copper layer thickness to nickel layer thickness should be increased to about 2:1. In addition to the ASTM standard, the automotive industry has set minimum electroplate composition and thickness requirements for electroplated plastics. For superior corrosion protection, duplex nickel deposits are used over a copper electroplate. The duplex nickel deposits retard corrosion penetration to the underlying copper electroplate by using a sulfur-free, semi-bright nickel plate under the bright nickel electroplate. When corrosion occurs at a discontinuity in the chromium plate and penetrates through the bright nickel layer to the semi-bright nickel, a corrosion cell allows the more active bright nickel layer to corrode laterally rather than allowing penetration through the semi-bright nickel to the copper layer.

Is has been generally recognized in the industry that it would be desirable to eliminate the underlying copper layer in order to achieve a better appearance when corrosion occurs, because copper forms an undesirable green corrosion product when exposed to marine or industrial atmospheres. It will also be recognized by those skilled in the art that eliminating the copper layer would also have the advantage of reducing the number of process steps involved in preparing a decorative chrome plated article, and could potentially lower product cost. Also, recyclability of finished parts and/or plating waste could be improved if the copper layer is eliminated.

U.S. Pat. No. 3,868,229, entitled "Decorative Electroplates For Plastics," discloses a process for electroplating plastic with a decorative nickel chrome using essentially an all nickel composition by depositing a sublayer of low strength nickel onto a plastic surface which has been made conductive, depositing over the sublayer a super leveling nickel layer followed by deposition of a chromium layer. In order to pass thermal cycle testing, it is disclosed that the ratio of the thickness of the nickel sublayer to the thickness of the super leveling nickel must be at least 2, and the total nickel plate thickness is from about 0.9 to about 1.6 mils. Thus, a disadvantage with the process described by U.S. Pat. No. 3,868,229 is that while it reduces the number of steps required, the total thickness of the nickel layers is significantly greater than the total thickness of the nickel layers in a conventional chromium plating for plastic substrates that has an underlying copper layer. For example, the total thickness of the bright nickel and semi-bright nickel layers that are needed to meet the corrosion and thermal cycle performance requirements of ASTM-604 is typically less than 0.9 mils, whereas the total thickness of the super leveling bright nickel and the non-leveling nickel layers in accordance with the teachings of U.S. Pat. No. 3,868,229 must be from about 0.9 to about 1.6 mils to meet the same requirements. Therefore, any savings associated with elimination of the underlying copper layer is at least partially offset by the added cost associated with using thicker nickel layers.

In view of the above discussion, it is evident that there remains a need for a process for depositing a decorative electroplate on plastics which does not include an underlying copper electroplate layer, and which meets corrosion and thermal cycle test requirements without requiring thicker nickel layers.

SUMMARY OF THE INVENTION

In one aspect, the invention provides a process for depositing a decorative chrome electroplate on a plastic substrate without requiring a copper electroplate sublayer, while utilizing very thin nickel electroplate layers. The process reduces the number of steps required for forming a decorative chrome electroplate on a plastic substrate, and reduces the number of electroplate baths needed, without requiring additional nickel, thereby reducing the cost of a finished product.

The process of this invention generally comprises steps of electrodepositing on an electrically conductive coating a high leveling semi-bright nickel electroplate layer, electroplating on the high leveling semi-bright nickel electroplate layer a bright nickel electroplate layer, and electrodepositing over the bright nickel electroplate a layer of chromium.

The decorative chromium plating prepared in accordance with the process of this invention is capable of passing corrosion and thermal cycle test requirements without an electrodeposited copper layer, while having a total thickness of nickel layers that is about equal to or less than the total thickness of conventional chrome platings exhibiting the desired corrosion resistance and thermal cycling characteristics.

These and other features, advantages and objects of the present invention will be further understood and appreciated by those skilled in the art by reference to the following specification, claims and appended drawings.

DESCRIPTION OF PRIOR ART

Figure 1:
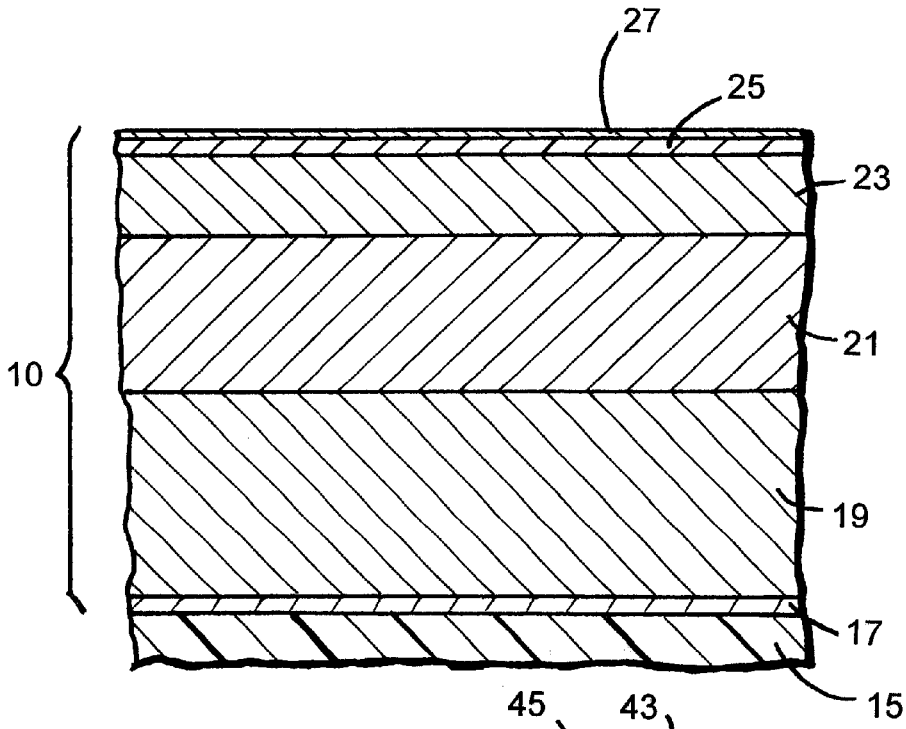
Fig. 1 (PRIOR ART)
FIG. 1 is a schematic cross-sectional view of a chromium plating on a plastic substrate, in which the plating includes a copper sublayer in accordance with the prior art.

In FIG. 1, there is shown a conventional chromium plated plastic part. Typical applications include various automotive parts, such as grilles, wheel covers, door handles and the like. For such applications, the chrome plating 10 must exhibit good corrosion resistance, and good thermal cycling properties. The conventional plating 10 is a composite comprising a plurality of layers that are sequentially deposited on the plastic substrate 15. The first layer 17 is an electrolessly deposited nickel or copper plating or coating 17. A conventional process for formation of an electroless coating generally involves steps of etching the substrate 15, neutralizing the etched surface, catalyzing the neutralized surface in a solution that contains palladium chloride, stannous chloride and hydrochloric acid followed by immersion in an accelerator solution (which is either an acid or a base), and forming a metallic coating on the activated substrate. The surface of substrate 15 is typically etched by dipping the substrate in an etchant (e.g., a mixed solution of chromic acid and sulfuric acid). The metallic coating may be deposited on the activated substrate by immersing the substrate in a chemical plating bath containing nickel or copper ions and depositing the metal thereon from the bath by means of the chemical reduction of the metallic ions. The resulting metallic coating is useful for subsequent electroplating because of its electrical conductivity. It is also conventional to wash the substrate with water after each of the above steps. Other suitable techniques for pretreating a plastic substrate to provide an electrically conductive coating to render the substrate receptive to electroplating operations are well known in the art.

Typical plastic materials that have been rendered receptive to electroplating, and which are subsequently electroplated to provide a brilliant, lustrous metallic finish include acrylonitrile-butadiene styrene (ABS) resins, polyolefins, polyvinyl chloride, polycarbonate (PC) ABS alloy polymer and phenol-formaldehyde polymers. The processes of this invention may be applied to these and other plastics. However, preferred materials for automotive applications are ABS or PC/ABS.

In accordance with conventional prior art techniques, a copper layer 19 is electrodeposited on layer 17. A typical thickness for the copper layer 19 is about 0.7 mils (or about 18 microns). As previously stated, it has generally been believed by those skilled in the art that a copper sublayer 19 is needed to meet thermal cycling requirements. Were it not for the belief that the copper layer is necessary to achieve good thermal cycling properties, those skilled in the art would prefer to omit the copper layer to mitigate problems associated with corrosion, and to simplify the chrome plating process.

For the conventional chrome plated plastic parts, a semi-bright nickel layer 21 is electrodeposited over copper layer 19. In order to meet corrosion resistance requirements and thermal cycling requirements for typical automotive applications, semi-bright nickel layer 21 is generally about 0.60 mils (about 15 microns) thick. Typically, a bright nickel layer 23 is electrodeposited over semi-bright nickel layer 21. A typical thickness for bright nickel layer 23 is about 0.24 mils (about 6 microns). The two nickel layers 21 and 23 provide superior corrosion protection over copper layer 19. The two nickel layers retard corrosion penetration to the underlying copper layer 19 by utilizing a sulfur-free, semi-bright nickel layer 21 under the bright nickel layer 23. When corrosion occurs at a discontinuity in the overlying chromium layer and penetrates through the bright nickel layer 23 to the semi-bright nickel layer 21, a corrosion cell allows the more active bright nickel layer 23 to corrode laterally rather than allowing penetration through the semi-bright nickel layer 21 to the copper layer 19.

Optionally, a microporous nickel layer 25 is provided to further retard corrosion penetration. The microporous nickel layer 25 is typically a very thin layer (e.g., on the order of 2.5 microns or less). A chromium layer 27 is electrodeposited over microporous nickel layer 25. The resulting chromium layer 27 has micro-discontinuities that retard corrosion penetration through the underlying nickel deposits (21 and 23) by exposing a larger area of the underlying nickel through the micropores. Electrodeposition of chromium layer 27 on microporous nickel layer 25 produces the microdiscontinuities. The microporous nickel layer 25 is typically about 0.1 mil (about 2.5 microns) thick and contains fine, inert particles that produce the micro-discontinuous chromium layer 27. Chromium layer 27 is typically at least about 0.010 mils (or 0.25 microns). The formation of micro-discontinuous chromium layers is well known to those skilled in the art, and is described in the published literature.

Figure 2:
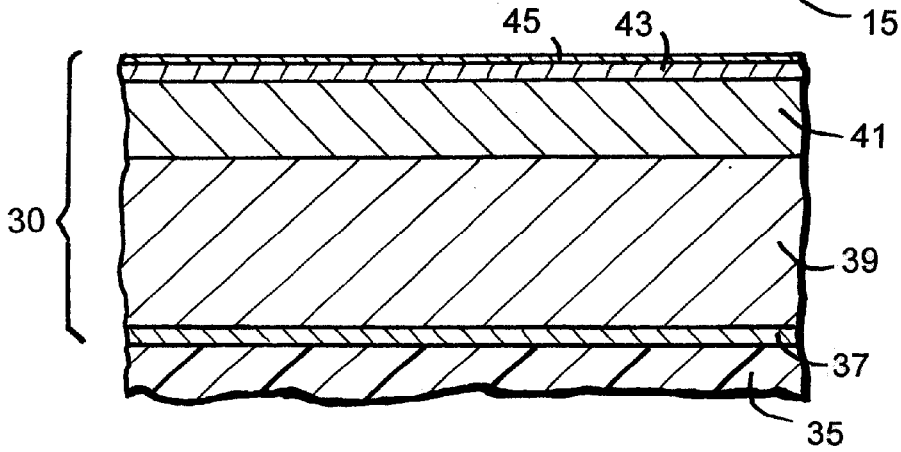
Fig. 2 (PRIOR ART)
FIG. 2 is a schematic cross-sectional view of a known chromium plating on a plastic substrate, in which the chromium plating is free of a copper sublayer.

In FIG. 2, there is shown a known composite decorative electroplate 30 for plastics. Electroplate 30 is comprised of an electrolessly deposited metallic layer 37 deposited on substrate 35, a non-leveling Watts nickel layer 39 deposited on metallic coating layer 37, a super leveling bright nickel layer 41 deposited on layer 39, a microporous nickel layer 43 electrodeposited on layer 41, and a chromium layer 45 deposited on layer 43. This "all nickel system" described in U.S. Pat. No. 3,868,229 has a total thickness of nickel layers 39 and 41 of from about 0.9 to about 1.6 mils, with the thicknesses of these two layers being interrelated so that the ratio of thickness of layer 39 to the thickness of layer 41 is at least about 2.

DESCRIPTION OF THE PREFERRED EMBODIMENTS

The invention generally pertains to a decorative chromium plating for a plastic substrate, wherein the chromium plating does not include an electrodeposited copper layer, and exhibits outstanding thermal cycling characteristics and corrosion resistance that are comparable to a conventional chromium plating for a plastic substrate that includes an electrodeposited copper layer.

Figure 3:
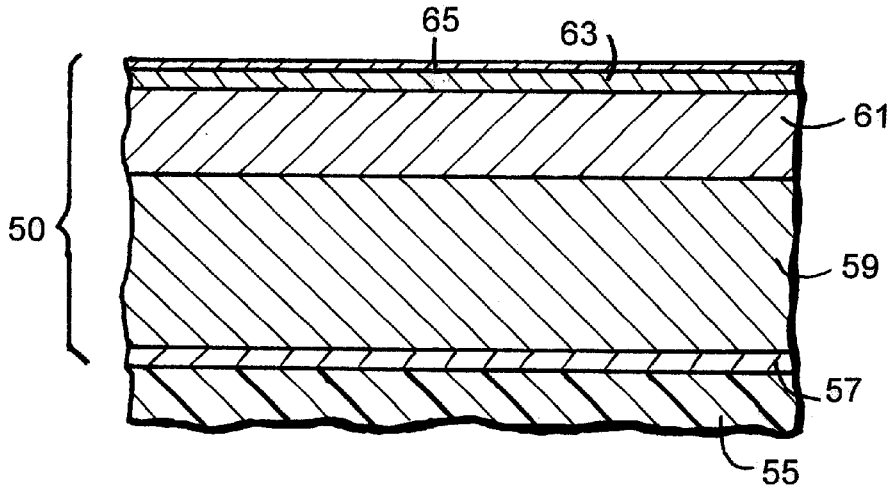
FIG. 3 is a schematic cross-sectional view of a copperless chromium plating on a plastic substrate in accordance with the invention.

A composite plating 50 in accordance with the invention is shown in FIG. 3. Composite plating 50 includes an electrolessly deposited metallic coating layer 57, similar to layers 37 and 17 described above with respect to the prior art, a high leveling semi-bright nickel layer 59 electrodeposited on layer 57, a bright nickel layer 61 electrodeposited on layer 59, a microporous nickel layer 63 (similar to layers 25 and 43 described above with respect to the prior art), and a chromium layer 65. As with the prior art, microporous layer 63 is desirable to further retard corrosion. However, microporous nickel layer 63 is not essential, and may be omitted without departing from the principles of this invention.

The essential features of this invention are that composite plating 50 does not include an electrodeposited copper layer, and that a high leveling semi-bright nickel layer 59 is first electroplated as a sublayer onto which a bright nickel layer 61 is electroplated. The bright nickel deposit 61 does not have to be super leveling as is taught by U.S. Pat. No. 3,868,220. In other words, the present invention is contradictory to the teachings of U.S. Pat. No. 3,868,229. Rather than electrodepositing a super leveling bright nickel over a non-leveling Watts nickel, the invention involves depositing a bright nickel over a high leveling semi-bright nickel. An advantage with the invention is that it is possible to eliminate the copper layer (that has been generally regarded as necessary to meet thermal cycling requirements), while using substantially less nickel than is required according to the teachings of U.S. Pat. No. 3,868,229. More specifically, the high leveling semi-bright nickel electroplate layer 59 of the invention is at least about 0.23 mils, and the bright nickel electrode layer 61 is from about 0.12 mils to about 0.4 mils thick. The all nickel system of U.S. Pat. No. 3,868,229 has a total nickel plate thickness of from about 0.9 mils to about 1.6 mils with the thickness of the nickel sublayer being at least twice the thickness of the super-leveling nickel layer. This system is functionally limited to a thin plate thickness range in order to achieve thermal cycle capability. This limitation is due to the use of the Watts nickel and "super" leveling bright nickel. In contrast, the total thickness of nickel layers 59 and 61 of the present invention does not have an upper limit, and is desirably less than or about equal to 1 mil, and are more desirably less than 0.9 mil, with good corrosion resistance and adequate thermal cycling characteristics being achieved for total nickel layers thicknesses at least as low as about 0.5 mils. Heavier electroplating thicknesses may be used where required.

The high leveling semi-bright nickel electroplate layer 59 has a tensile stress of about 20,000 psi or less, and a ductility of about 0.4 or higher as determined in accordance with ASTM-B-490. The bright nickel electroplate layer 61 has a ductility of about 0.25 or higher per ASTM-B-490. The high leveling semi-bright nickel layer 59 may be sulfur free, or at least substantially sulfur free (i.e., contains only trace amount of sulfur in the form of an impurity, not as an additive). Preferably, an electrolytic potential of at least +100 millivolts is maintained between the high leveling semi-bright nickel electroplate layer 59 and the bright nickel layer 61.

Substrate 15 is preferably an ABS substrate or a blend of polycarbonate and ABS. The high leveling semi-bright nickel layer 59 is more noble (corrosion resistant) than the bright nickel layer 61.

Specific embodiments of the invention will be described below in the illustrative examples. It will be understood that the examples are not intended to be limiting of the scope of the invention.

EXAMPLE I

Parts molded in Dow Magnum® 3490 ABS were provided with a conductive metal coating using an electroless deposition process. The coated ABS parts were then electroplated using a conventional plating sequence: electrolytic acid copper electroplate (Table I),

TABLE I

| Conventional Electrolytic Bright Acid Copper | |
|---|---|
| 22–26 oz/gal | $Cu5O_4.5H_2O$ |
| 12–16 oz/gal | $H_2SO_4$ |
| 65–100 ppm | Chloride |
| 0.3% | Procom Make-up |
| 0.2% | Procom Brightener |
| >0.5 | Ductility |
| 68–80° F. | Temperature |
| 20 ASF | Current Density |
| 20 Minutes | Plating Time |

electrolytic semi-bright nickel (Table II), electrolytic bright nickel (Table III), electrolytic

TABLE II

| Conventional Electrolytic Semi-Bright Nickel | |
|---|---|
| 24–45 oz/gal | $NiSO_4.6H_2O$ |
| 3–5 oz/gal | $NiCl_2.6H_2O$ |
| 6–8 oz/gal | $H_3BO_3$ |
| 2–6 oz/gal | Udylite B Maintenance |
| 0.4–1% V | Udylite B |
| .1% V | Udylite TL |
| 4.0–4.568–80° F. | pH |
| 140° F. | Temperature |
| 30–60 dynes/crm | Surface Tension |
| .4–.5 | Ductility |
| 10,000–25,000 psi | Stress |
| 25 minutes | Plating Time |
| 40 ASF | Current Density |

TABLE III

| Conventional Electrolytic Bright Nickel | |
|---|---|
| 24–45 oz/gal | $NiSO_4.6H_2O$ |
| 6–10 oz/gal | $NiCl_2.6H_2O$ |
| 6–8 oz/gal | $H_3BO_3$ |
| 1.7–2.7 grms/liter | Udylite Index 61A |
| 3–4 grms/liter | Udylite 63 |
| .05% dynes/am | Surface Tension |
| 3.6–4.4 | pH |
| 140° F. | Temperature |
| 0.2–0.45 | Ductility |
| 5,000–10,000 psi | Stress |
| 10 minutes | Plating Time |
| 40 ASF | Current Density |

porous nickel (Table IV), and a decorative chromium electroplate. The process produced

TABLE IV

| Conventional Electrolytic Particle Nickel | |
|---|---|
| 26–45 oz/gal | $NiSO_4.6H_2O$ |
| 6–10 oz/gal | $NiCl_2.6H_2O$ |
| 6–8 oz/gal | $H_3BO_3$ |
| 3–4 grms/liter | Udylite 61A |
| 3–4 grms/liter | Udylite 63 |
| 0.1% | Proprietary Particle Mix |
| 0.02% | Udylite Mayruss S |
| 0.07% | Udylite XPN 366 Enhancer |
| 3.6–4.4 | pH |
| 145° F. | Temperature |
| 5,000–20,000 psi | Stress |

lustrous decorative chromium electroplated parts. These parts were tested in accordance with ASTM-B-604, SC5 for corrosion and thermal cycle performance. The parts were acceptable per the test requirements. The results are summarized in Table VI.

EXAMPLE 2

Another group of ABS parts having an electrolessly applied metal coating were electroplated using the principles of this invention by eliminating the electrolytic copper and electrolytic semi-bright nickel from Example 1 and substituting therefore an electrolytic nickel with low stress, high ductility and high leveling properties (Table V). The process produced

TABLE V

| Low Stress, High Ductility and High Leveling Nickel Electroplate | |
|---|---|
| 26.0–34.0 oz/gal | $NiSO_4.6H_2O$ |
| 3.0–5.0 oz/gal | $NiCl_2.6H_2O$ |
| 6.0–9.0 oz/gal | $H_3BO_3$ |
| 4.0–4.5 | pH |
| 125–135° F. | Temperature |
| 125–175 ppm | Coumarin |
| 35.0–45.0 dynes/cm | Surface Tension |
| <100 ppm | Melilotic Acid |
| 0.4–0.5 | Ductility |
| 10,000–18,000 psi | Stress |
| 25 ± 3 minutes | Plating Time |
| 40 ASF | Current Density |

lustrous, decorative chromium electroplated parts equivalent in appearance to the parts plated with the conventional plating sequence described in Example 1. The parts were tested per ASTM-604, SC5 for corrosion and thermal cycle performance. The parts were acceptable. When parts were corrosion tested to failure, the conventional plated parts (from Example 1) failed at 200 hours of CASS and the specimens without the acid copper electroplate (in accordance with Example 2) passed at 200 hours. The results are summarized in Table VI.

TABLE VI

| Example | Electroplate Thickness (Mils) | | | | | | |
|---|---|---|---|---|---|---|---|
| Thermalcycle | Cu | SBNi | BrNi | SPNi | TNi | Cr | |
| 1A | 0.99 | 0.31 | 0.35 | ANM | 0.65 | NM | Pass |
| 1B | 0.01 | 0.28 | 0.21 | NM | 0.49 | 0.02 | Pass |
| 1C | 0 | 0.68 | 0.30 | 0.06 | 1.03 | NM | Pass |
| 1D | 0 | 0.29 | 0.23 | NM | 0.51 | 0.02 | Pass |
| 2A | 0.95 | 0.65 | 0.31 | 0.5 | 1.0 | .03 | Pass |
| 2B | 0 | 0.48 | 0.18 | 0.06 | .72 | 0.03 | Pass |

1A ▼
1B Conventional electroplate on ABS grille ornament
1C ▼
1D All nickel electroplate on ABS grille ornament
2A Conventional electroplate on PC/ABS grille ornament
2B All nickel electroplate on PC/ABS grille ornament
NM = Not measured
TNi - Total Nickel

EXAMPLE 3

The plating process in Example 1 was repeated with a polycarbonate/ABS resin alloy, by both conventional and non-conventional plating sequences. Both plating sequences produced lustrous, decorative chromium electroplated parts equivalent in appearance. Parts from both plating sequences passed corrosion and thermal cycle testing per ASTM-B-604, SC5. When parts were corrosion tested to failure, the conventional plated parts failed at 132 hours of CASS and the specimens in accordance with the invention failed at 400 hours. The results are summarized in Table VI.

EXAMPLE 4

The conventional plating sequence of Example 1 was repeated by plating on Dow Magnum® 3490 ABS. The non-conventional plating process was used on ABS by deleting the acid copper plating step in the conventional process and continuing the electroplate sequence with the semi-bright nickel (Table II). The results are summarized in Table VI.

Although the examples illustrate an all nickel plating on ABS and polycarbonate/ABS, the performance of other resins with this plating composition is believe to be equivalent when properly preplated.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A process for forming a decorative chromium plating on a plastic substrate, comprising:

electrolessly depositing an electrically conductive coating on a plastic substrate;

electrodepositing on the electrically conductive coating a leveling semi-bright nickel electroplate layer, said leveling semi-bright nickel electroplate layer having a tensile stress of about 20,000 psi or less and a ductility of about 0.4 or higher as determined in accordance with ASTM-B-490, said leveling semi-bright nickel electroplate layer being deposited from an electrolyte comprised of nickel sulfate, nickel chloride and boric acid;

electrodepositing on the leveling semi-bright nickel electroplate layer a bright nickel electroplate layer; and electrodepositing over the bright nickel electroplate layer a chromium electroplate layer.

2. The process of claim 1, further comprising depositing a microporous nickel layer on the bright nickel electroplate layer, and depositing the chromium electroplate layer on the microporous nickel layer, whereby the chromium layer has microscopic discontinuities that retard corrosion penetration through the underlying nickel layers by exposing a larger area of the underlying nickel.

3. The process of claim 1, wherein the leveling semi-bright nickel electroplate layer is from about 0.23 mils.

4. The process of claim 1, wherein the bright nickel electroplate layer is at least about 0.12 mils thick.

5. The process of claim 1, wherein the bright nickel electroplate layer has a ductility of about 0.25 or higher per ASTM-B490.

6. The process of claim 1, wherein the plastic substrate is comprised of ABS or PC/ABS.

7. The process of claim 1, wherein an electrolytic potential of at least +100 millivolts is maintained between the leveling semi-bright nickel electroplate layer and the bright nickel electroplate layer.

8. The process of claim 1, wherein the plastic substrate is a plateable resin.

9. The process of claim 1, wherein the electrically conductive coating that is electrolessly deposited is an electrolessly deposited nickel.

10. The process of claim 1, wherein the electrically conductive coating that is electrolessly deposited is an electrolessly deposited copper.

11. A decorative chromium plating on a plastic substrate having an electrolessly deposited electrically conductive coating, comprising:

a leveling semi-bright nickel electroplate layer on the electrically conductive coating, said leveling semi-bright nickel electroplate layer having a tensile strength of about 20,000 psi or less and a ductility of about 0.4 or higher as determined in accordance with ASTM-B-490, said leveling semi-bright nickel electroplate layer being deposited from an electrolyte comprised of nickel sulfate, nickel chloride and boric acid;

a bright nickel electroplate layer on the leveling semi-bright electroplate layer; and a chromium electroplate layer on the bright nickel electroplate layer.

12. The decorative chromium plating of claim 11, further comprising a microporous nickel layer interposed between the bright nickel electroplate layer and chromium electroplate layer, the chromium layer having microscopic discontinuities that retard corrosion penetration thought the underlying nickel layers by exposing a larger area of the underlying nickel.

13. The decorative chromium plating of claim 11, wherein the leveling semi-bright nickel electroplate layer is at least about 0.23 mils.

14. The decorative chromium plating of claim 11, wherein the bright nickel electroplate layer is at least about 0.12 mils thick.

15. The decorative chromium plating of claim 11, wherein the bright nickel electroplate layer has a ductility of about 0.25 or higher per ASTM-B-490.

16. The decorative chromium plating of claim 11, wherein the plastic substrate is comprised of ABS or PC/ABS.

17. The decorative chromium plating of claim 11, wherein an electrolytic potential of at least about +100 millivolts is maintained between the leveling semi-bright nickel electroplate layer and the bright nickel electroplate layer.

18. The decorative chrome plating of claim 11, wherein the plastic substrate is a plateable resin.

19. A process for forming a decorative chromium plating on a plastic substrate, comprising:

electrolessly depositing an electrically conductive coating on the plastic substrate;

electrodepositing on the electrically conductive coating a leveling semi-bright nickel electroplate layer having a tensile stress of about 20,000 psi or less and a ductility of about 0.4 or higher as determined in accordance with ASTM B-490, the leveling semi-bright nickel electroplate layer being deposited from an electrolyte containing nickel sulfate, nickel chloride, boric acid and an organic leveling agent in an amount that is effective to impart high leveling characteristics;

electrodepositing on the leveling semi-bright nickel electroplate layer a bright nickel electroplate layer; and electrodepositing over the bright nickel electroplate layer a chromium electroplate layer.

20. The process of claim 19, wherein the nickel sulfate is present in the electrolyte in an amount of from 26.0 to 34.0 ounces per gallon, the nickel chloride is present in the electrolyte in an amount of from 3.0 to 5.0 ounces per gallon, and the boric acid is present in an amount from 6.0 to 9.0 ounces per gallon.

21. The process of claim 20, wherein the organic leveling agent is comparing.

22. The process of claim 21, wherein the comparing is present in the electrolyte in an amount of from 125 to 175 ppm.

23. A decorative chromium plating on a plastic substrate having an electrolessly deposited electrically conductive coating, comprising:

a leveling semi-bright nickel electroplate layer on the electrically conductive coating, the leveling semi-bright nickel electroplate layer having a tensile stress of about 20,000 psi or less and a ductility of about 0.4 or higher as determined in accordance with ASTM-B-490, said leveling semi-bright nickel electroplate layer being deposited from an electrolyte containing nickel sulfate, nickel chloride and boric acid;

a bright nickel electroplate layer on the leveling semi-bright nickel electroplate layer; and a chromium electroplate layer on the bright nickel electroplate layer.

24. The decorative chromium plating of claim 23, wherein the leveling semi-bright nickel electroplate layer is deposited from an electrolyte containing an organic leveling agent in an amount that is effective to impart high leveling characteristics.

25. The decorative chromium plating of claim 23, wherein the nickel sulfate is present in the electrolyte in an amount of from 26.0 to 34.0 ounces per gallon, the nickel chloride is present in the electrolyte in an amount of from 3.0 to 5.0 ounces per gallon, and the boric acid is present in an amount from 6.0 to 9.0 ounces per gallon.

26. The decorative chromium plating of claim 24, wherein the organic leveling agent is coumarin.

27. The decorative chromium plating of claim 26, wherein the comparing is present in the electrolyte in an amount of from 125 to 175 ppm.

* * * * *

UNITED STATES PATENT AND TRADEMARK OFFICE

CERTIFICATE OF CORRECTION

PATENT NO. : 6,468,672 B1
DATED : October 22, 2002
INVENTOR(S) : Lawrence P. Donovan, III et al.

It is certified that error appears in the above-identified patent and that said Letters Patent is hereby corrected as shown below:

Column 2,
Line 3, "Is" should be -- It --;

Column 5,
Line 37, "are" should be -- is --;

Column 8,
Line 53, "ASTM-B490" should be -- ASTM-B-490 --;

Column 9,
Line 21, "thought" should be -- through --;
Line 49, "ASTM B-490" should be -- ASTM-B-490 --;

Column 10,
Lines 15, 16 and 48, "comparing" should be -- coumarin --;

Signed and Sealed this

First Day of April, 2003

JAMES E. ROGAN
*Director of the United States Patent and Trademark Office*